US012569092B2

(12) United States Patent
Manning

(10) Patent No.: US 12,569,092 B2
(45) Date of Patent: Mar. 10, 2026

(54) PORTABLE SHOWER CURTAIN DEVICE

(71) Applicant: Jill Lyn Manning, Chicago, IL (US)

(72) Inventor: Jill Lyn Manning, Chicago, IL (US)

(73) Assignee: Jill Manning, Chicago, IL (US)

( * ) Notice: Subject to any disclaimer, the term of this patent is extended or adjusted under 35 U.S.C. 154(b) by 132 days.

(21) Appl. No.: 18/786,477

(22) Filed: Jul. 27, 2024

(65) Prior Publication Data

US 2025/0127341 A1 Apr. 24, 2025

Related U.S. Application Data

(60) Provisional application No. 63/579,108, filed on Aug. 28, 2023.

(51) Int. Cl.

| | |
|---|---|
| ***A47K 3/38*** | (2006.01) |
| ***A47H 1/02*** | (2006.01) |
| ***A47H 1/102*** | (2006.01) |

(52) U.S. Cl.

CPC ..... *A47K 3/38* (2013.01); *A47H 1/02* (2013.01); *A47H 1/102* (2013.01); *A47H 2001/021* (2013.01)

(58) Field of Classification Search

CPC . A47K 3/38; A47H 1/02; A47H 1/102; A47H 2001/021

USPC ..... 4/608

See application file for complete search history.

(56) References Cited

U.S. PATENT DOCUMENTS

| | | | | |
|---|---|---|---|---|
| 5,732,420 | A * | 3/1998 | Micciche | A47K 3/38 4/610 |
| 5,794,281 | A * | 8/1998 | Shearon | A47K 3/38 4/558 |
| 12,207,770 | B1 * | 1/2025 | Heidebrink | A47K 3/38 |
| 2014/0289957 | A1 * | 10/2014 | Whittaker | A47K 3/38 4/608 |
| 2015/0327729 | A1 * | 11/2015 | Tarnowski | A47K 3/38 4/608 |

* cited by examiner

*Primary Examiner* — Huyen D Le

(57) ABSTRACT

The present disclosure discloses a shower curtain device. The device may include a base arm configured to attach to a shower frame, and an extendable arm attached to the base arm. The extendable arm may be configured to fold and pull out to reach to a wall. The device may further include a shower curtain configured to be placed over the extendable arm. The device may additionally include a suction cup attached to the extendable arm. The suction cup may be configured to hold the extendable arm in place on the wall.

1 Claim, 1 Drawing Sheet

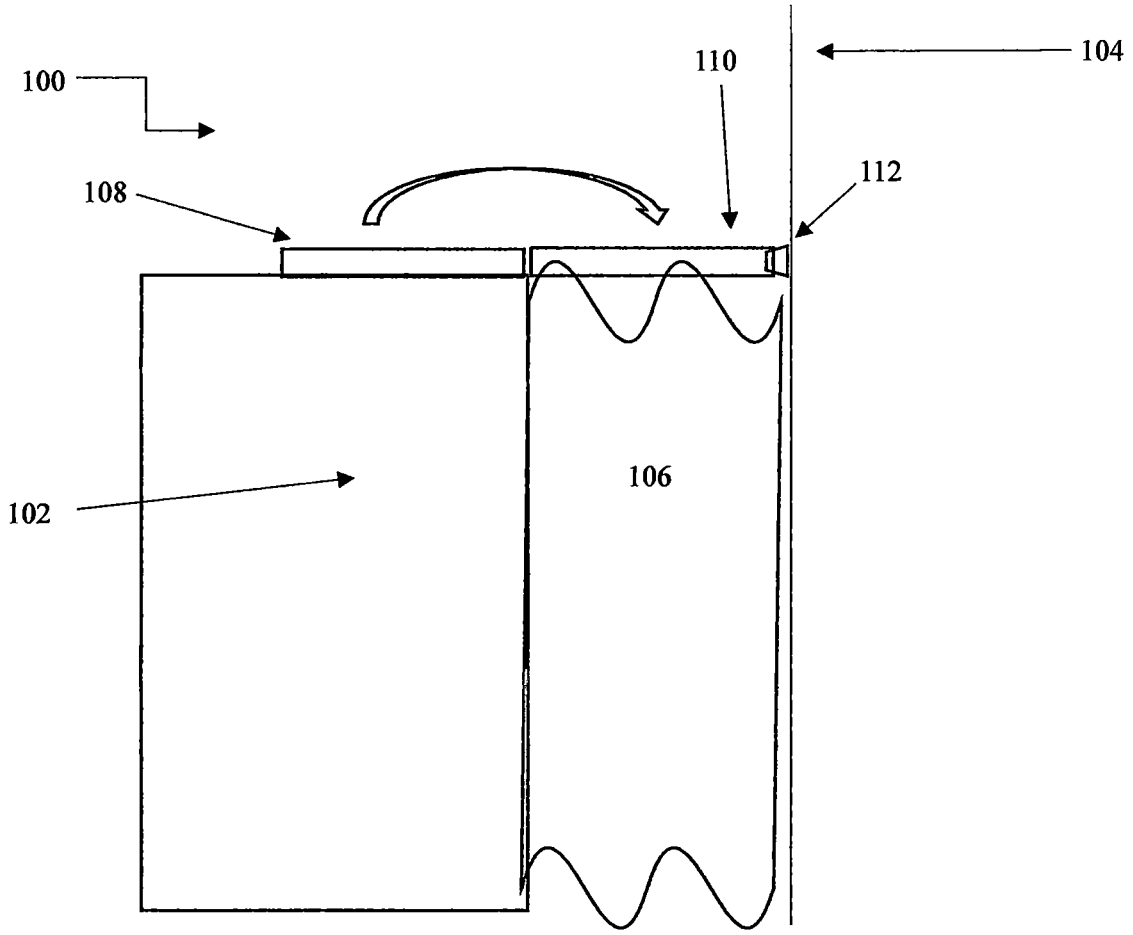
100
108
110
104
112
102
106

PORTABLE SHOWER CURTAIN DEVICE

BACKGROUND OF THE INVENTION

Field of the Invention

The present invention relates generally to a shower curtains, and specifically to a portable device configured to attach to glass shower partitions that extends to the wall and that includes a shower curtain to protect the bathroom floor from water leakage.

Description of the Related Art

Many hotel stand up showers include glass partitions that do not fully extend to the wall, leaving an open space. These partial glass partitions are safety hazards, as they do not prevent water from spilling on the bathroom floor. Specifically, partially open showers do not prevent water from splashing out onto the hotel bathroom floor, creating a potential to slip and fall. Water spillage also causes inconvenience to the users, as they have to clean up the water spillage after showering, in many cases with hotel towels. This adds to water wastage, as then more water is required to clean the hotel towels.

Partially open showers also create a draft, which may cause the users to feel cold, even if the water from the shower is hot.

Therefore, a device is required that prevents water from spilling onto the bathroom floor from partially open showers.

SUMMARY OF THE INVENTION

The following presents a simplified summary of the present disclosure in a simplified form as a prelude to the more detailed description that is presented herein.

In accordance with embodiments of the invention, there is provided a shower curtain device. The device may include a base arm configured to attach to a shower frame, and an extendable arm attached to the base arm. The extendable arm may be configured to fold and pull out to reach to a wall. The device may further include a shower curtain configured to be placed over the extendable arm. The device may additionally include a suction cup attached to the extendable arm. The suction cup may be configured to hold the extendable arm in place on the wall.

The portable shower curtain device, as described herein the present disclosure, prevents water from spilling onto bathroom floor from a partially open shower. The device is light weight and easy to carry. Further, it is easy to assemble and disassemble the device; therefore, the device is easy to use.

These and other features, aspects, and advantages of the present invention will become better understood with reference to the following description.

BRIEF DESCRIPTION OF THE DRAWINGS

Illustrative embodiments of the present invention are described herein with reference to the accompanying drawings, in which:

FIG. 1 depicts a portable shower curtain device in accordance with embodiments of the invention.

DESCRIPTION OF INVENTION

FIG. 1 depicts a portable shower curtain device 100 (or device 100) in accordance with embodiments of the invention. The device 100 may be configured to be removably attached to a partially open shower 102. In some aspects, the device 100 may be configured to attach to the partially open shower 102 (e.g., glass shower partitions) that extends to a wall 104. The device 100 may include a shower curtain 106 that protects the bathroom floor from water leakage, protects users from slipping/falling, and prevents additional water waste from using towels to sop water from the floor.

The device 100 may include a base arm 108 made of plastic and silicone, an extendable arm 110 attached to the base arm 108, the shower curtain 106, a wall suction cup 112 and a carry case (not shown) configured to store/hold the components described above for travel/transportation purpose. The carry case may make the device 100 portable.

The base arm 108 may be configured to attach to the existing glass or metal top shower frame. The extendable arm 110 may be configured to fold and pull out to reach to the wall 104, creating a temporary shower curtain rod. The extendable arm 110 may be attached to the base arm 108. The shower curtain 106 may then be placed or slipped over the extendable arm 110. The wall suction cup 112 may be configured to hold the extendable arm 110 in place on the wall 104.

In operation, a user may attach the base arm 108 to the shower partition, then unfold and extend the extendable arm 110 out towards the wall 104, and attach it to the wall 104 with the suction cup 112. The user may then place/slip over/wrap the shower curtain 106 over the extendable arm 110 and secure with Velcro™.

In some aspects, to manufacture the device 100, a hard plastic 3-sided 'frame' lined with silicone may be made that fits over any shower frame or partition without falling. The extendable arm 110 may be attached by a material similar to a bungee cord (e.g., a water resistant and durable material), and the suction cup 112 may be glued to the end of the extendable arm 110. The shower curtain 106 may be a simple plastic or fabric curtain that may either slip over the extendable arm 110 or wrap around it and secured with Velcro™. The carrying case may be made of canvas or vinyl bag.

The device 100, as described herein the present disclosure, prevents water from spilling onto bathroom floor from a partially open shower. The device 100 is light weight and easy to carry. Further, it is easy to assemble and disassemble the device 100; therefore, the device 100 is easy to use.

Except as may be expressly otherwise indicated, the article "a" or "an" if and as used herein is not intended to limit, and should not be construed as limiting, the description or a claim to a single element to which the article refers. Rather, the article "a" or "an" if and as used herein is intended to cover one or more such elements, unless the text expressly indicates otherwise.

The claimed invention is:

1. A shower curtain device comprising:

a base arm configured to attach to a shower frame;

an extendable arm attached to the base arm, wherein the extendable arm is configured to fold and pull out to reach to a wall;

a shower curtain configured to be placed over the extendable arm; and a suction cup attached to the extendable arm, wherein the suction cup is configured to hold the extendable arm in place on the wall.

* * * * *